US005208571A

United States Patent [19]

Müller

[11] Patent Number: 5,208,571

[45] Date of Patent: May 4, 1993

[54] MAGNET WINDING WITH LAYER TRANSITION COMPENSATION

[75] Inventor: Wolfgang H.-G. Müller, Karlsruhe, Fed. Rep. of Germany

[73] Assignee: Bruker Analytische MeBtechnik GmbH, Fed. Rep. of Germany

[21] Appl. No.: 719,124

[22] Filed: Jun. 21, 1991

[30] Foreign Application Priority Data

Jun. 23, 1990 [DE] Fed. Rep. of Germany ..... 4020112

[51] Int. Cl.[5] ..... H01F 5/00

[52] U.S. Cl. ..... 335/299

[58] Field of Search ..... 335/216, 296, 297, 298, 335/299, 213, 214; 336/225, 230, 127, 200, DIG. 1; 174/15.4, 15.5, 125.1; 505/705, 844, 879, 892, 924

[56] References Cited

U.S. PATENT DOCUMENTS

| | | | |
|---|---|---|---|
| 2,911,605 | 11/1959 | Wales | 336/200 |
| 3,002,260 | 10/1961 | Shortt et al. | 336/200 |
| 3,333,331 | 8/1967 | Swartz | 505/924 |
| 4,623,864 | 11/1986 | Inoue et al. | 335/299 |
| 4,962,329 | 10/1990 | Fujita | 336/200 |

FOREIGN PATENT DOCUMENTS

| | | | |
|---|---|---|---|
| 59-11603 | 1/1984 | Japan | 335/216 |
| 60-133710 | 7/1985 | Japan | 505/879 |
| 0158606 | 8/1985 | Japan | 505/879 |
| 0177604 | 9/1985 | Japan | 505/879 |
| 311707 | 1/1991 | Japan | 505/879 |
| 910390 | 11/1962 | United Kingdom | 335/299 |

OTHER PUBLICATIONS

"Bitter-Type Coil Connectors".

Solenoid Magnet Design, The Magnetic and Mechanical Aspects of Resistive and Superconducting Systems, by D. Bruce Montgomery, 1980, Robert E. Krieger Publishing Company, Huntington, New York.

*Primary Examiner*—Leo P. Picard
*Assistant Examiner*—Ramon M. Barrera
*Attorney, Agent, or Firm*—Walter A. Hackler

[57] ABSTRACT

A magnet winding in a air coil configuration with windings made from conducting elements which surrounds a magnetic field axis and is wound in at least two layers with at least one layer transition, is characterized in that, in an angular region about the magnetic field axis which includes a layer transition, the radial separation from the magnetic field axis of at least the radially innermost winding of a respective layer is less than that in the other angular region. In this manner, it is, to a large extent, possible to compensate for the magnetic field breach resulting from the "thinning" of the effective active conducting elements of the innermost winding in the region of the layer transition.

30 Claims, 5 Drawing Sheets

A
B
C
D
E
F
G
α
β
d/2
d

MAGNET WINDING WITH LAYER TRANSITION COMPENSATION

BACKGROUND OF THE INVENTION

The invention concerns a magnet winding in an air coil configuration with windings built from conducting elements which surround a magnetic field axis and are wound in at least two layers with at least one layer transition.

A magnet winding of this kind is, by way of example, known in the art from the publication "SOLENOID MAGNET DESIGN, The Magnetic and Mechanical Aspects of Resistive and Superconducting Systems" by D. Bruce Montgomery, 1980, Robert E. Krieger Publishing Company, Huntington, N.Y.

For many applications, a highly homogeneous magnetic field, which can be produced with the aid of axially symmetric, in particular, rotationally symmetric coil configurations is necessary. For the production of such fields, loops or rings are necessary which, in practice, must be wound from wires whose diameter can be relatively large compared to the winding radius, in particular, with coils from normally conducting copper wire. Actual coils require a transition from one winding layer to another which results in a considerable winding error. In an angular region about the coil axis in which the transition from one layer to another takes place, the corresponding innermost radial winding has, on the average, only one conducting element per two layers compared to two conducting elements in the other angular region outside of the layer transition, that is to say, one in each layer. In this manner, a local defect in the magnetic field is produced by the coil in the region of the layer transition.

SUMMARY OF THE INVENTION

The object of the invention is, therefore, to provide for a magnet winding and for a method for its production with or by which the magnetic field error caused by the layer transition is at least partially compensated for.

This object is achieved in accordance with the invention in that, in one angular region about the magnetic field axis which includes a layer transition, the radial distance from the magnetic field axis of at least the radially innermost winding of the respective layer is less than that in the other angular region.

In consequence of the "thinning" in the radially innermost winding of the average number of conducting elements in two layers at the region of the layer transition to, on the average, only one half a conducting element for each layer, a reduced, in the angular region of the layer transition, contribution to the magnetic field inside the coil is effected by the current conducting coil compared to the regions outside of the layer transition. In double layer winding packets which are produced in accordance with the above referenced prior art using the oppositely spiral winding so-called "pancake" procedure, this field breach can be partially compensated for in that, on the average, an additional half of a conducting element per layer is arranged radially outward on the winding in the angular region of the layer transition in both layers in the region of the conductor inlet and outlet, which, in turn, is normally located on the outer side of the coil. However, this additional conducting element, due to its larger radial distance from the inside of the coil, does not compensate completely for the loss due to the missing conductor element in the radially innermost winding. In contrast, through the displacement of the inner border of the coil in the region of the layer transition towards the center of the field of the coil in accordance with the invention, the remaining considerable field reduction can be, to a large extent, compensated for and, in particularly advantageous cases, fully compensated for in that, the "thinning" of the conductor density in the transition layer region causing too small a field contribution can be counteracted with an increased field contribution due to the reduced radial distance of the "thinned" conductor region from the field axis.

Such a low symmetry, localized breach of the magnetic field can, by way of example, hardly be compensated for using shim coils. Rather, using the invention, a local error is particularly effectively mitigated against through local intervention.

The field error emanating from the layer transition is particularly large when the diameter of the conducting element is not negligibly small compared to the diameter of the coil, assuming, in particular, a value of at least 1/1000 or at least 1/100 of the coil radius of the magnetic winding. The improvement in the homogeneity of the magnetic field through the modification of the magnet winding in accordance with the invention is correspondingly large. The effect is larger the larger the number of windings per layer, in particular, when there are more than 10 windings per layer since, in consequence of the larger radial distance from the center of the field, the compensating field contribution from the additional conducting elements in the region of the conductor inlet and conductor outlet is, in this case, correspondingly weak.

In a preferred embodiment, the conducting elements are formed from a copper wire with rectangular, in particular square, cross section with one edge length of 10–12 mm, in particular, 11.6 mm and a bore running perpendicularly to its cross section. The inner diameter of the magnet winding in this embodiment assumes a value of 800–1000 mm, in particular, 900 mm. These dimensions are typical for resistive tomography magnets with liquid cooled conducting elements.

In an embodiment, the magnet winding exhibits an axially symmetric construction with respect to the magnetic field axis whereby, however, in an angular region about the magnetic field axis which includes a layer transition, deviation from the axial symmetry occurs. The axially symmetric construction of the magnet winding is a minimum requirement on the geometry of the coil configuration in order to produce a homogeneous magnetic field.

In a particularly preferred embodiment the magnet winding exhibits a largely rotationally symmetric construction. The overwhelming majority of coils for the production of homogeneous magnetic fields are, namely, rotationally symmetric ring coils which, in turn, can produce magnetic fields of particularly high spatial homogeneity using the modification in accordance with the invention.

In particular, in a variation of this embodiment with which the magnetic winding forms an n-fold Helmholtz configuration, extremely homogeneous magnetic fields can be produced with which the magnetic field terms up to order 2n can be zeroed. Alternatively, if one choses the parameters in such a form that the terms of higher order at the field center are not exactly zeroed, rather that the respective Helmholtz condition is only approximately fulfilled such that a small residual oscillation is allowed, it is possible to change the form of the homogeneity volume.

In a further embodiment of the invention, the magnetic field winding is constructed from two layers of opposite spiral windings each, in accordance with the "pancake" technique. In this manner, the radial winding transitions and the axial layer transitions are localized in a spatially narrow region in which the connecting pieces of the corresponding layers at the outer part of the coil are also located. This configuration is particularly advantageous for innerly cooled coils with hollow conducting elements since the coldest portion of the conducting elements at the cooling medium input location cools precisely the hottest portion of the conducting element at the cooling medium outlet location. In this manner, a more uniform temperature distribution is achieved over the entire winding region. With temperature gradients which are too large, geometric deformations of the coil due to the differing local heat expansion of the coil material occur during operation which would negatively influence the shape of the magnetic field and, in particular, its spatial homogeneity.

In a preferred embodiment, the breach caused by the layer transition is confined to an angular region about the magnetic field axis between 10 degrees and 30 degrees, in particular, 25 degrees.

In a further preferred embodiment, the radial distance from the magnetic field axis in the angular region about the layer transition at the middle of said angular region of at least the radially innermost winding of the corresponding layer is a half of a conducting element diameter less than that outside of the angular region. Even with this simple correction, a reduction in the field error caused by the layer transition by a factor of 10 compared to the usual symmetric winding arrangement can be achieved.

An embodiment with which the magnetic winding is part of a coil configuration for NMR tomography is particularly preferred. Precisely in this application area, a particularly high magnetic field homogeneity of the order of magnitude of $10^{-4}$ to $10^{-5}$ is required, whereby the homogeneity is required to extend over a relatively large volume while the constructive shape of the field-producing coils must be as compact as possible, that is to say, should be effected with as small an inner diameter as possible Therefore, in NMR tomography, the kind of field breach caused by a layer transition which can be largely compensated for using the magnetic winding modification according to the invention, is particularly serious.

In a particularly preferred improvement of this embodiment, the magnetic winding consists of at least two circularly cylindrical coaxial field coils. Furthermore, the magnetic winding is surrounded by a ferro-magnetic cylindrical jacket whose, influence on the homogeneity of the magnetic field produced by the coil configuration in an inner region defined by them, said inner region being accessible and suitable for accepting the body to be examined, is compensated for through the dimensioning of the field coils. This configuration facilitates the shielding of external interfering fields. In particular, however, the magnetic field produced by the electromagnets as well as the HF fields which need to be produced in tomography are limited to a region contained by the cylinder jacket. In this manner, the stray fields which normally propagate outward and which, in particular, can strongly impair the function of nearby electronic equipment as well as represent a danger to people with pace makers are largely avoided through a flux feedback.

The object of the invention is also achieved in a method for the production of a magnetic winding with at least two layers and at least one layer transition, in particular, a magnetic winding with the above described features with which, in an angular region about the magnetic field axis which includes the layer transition, at least the radially innermost winding of a respective magnetic winding surrounding a magnetic field axis, is wound with a reduced radial distance from the magnetic field axis compared to that in the other angular region.

In a preferred method, a winding template is utilized to wind which, in an angular region about the magnetic field axis which includes a layer transition between two layers of the winding, exhibits a radial recess at its periphery which extends in an axial direction over the region of those layers between which the layer transition occurs.

A particularly simple method utilizes a cylindrically formed winding template for winding whose circularly shaped cross section exhibits a segment shaped recess along the entire axial length of the winding template, whereby each respective layer transition of the magnet winding is wound in the region of the segment shaped recess. The most useful magnet coils for the production of homogeneous magnetic fields are, as already mentioned above, cylinder coils. It is particularly easy to produce a modified cylinder coil in accordance with the invention utilizing the above described method.

In a further method for the production of a modified magnet winding in accordance with the invention, after having wound a normally axially symmetric winding configuration, an additional conductor piece is attached in an electrically conducting fashion to at least the innermost respective winding of a magnetic winding surrounding the magnetic field axis in the angular region about the magnetic field axis which includes the layer transition. In this fashion it is also possible to retrofit a conventional magnet coil with the modification in accordance with the invention.

BRIEF DESCRIPTION OF THE DRAWINGS

The invention is further described and explained by means of the embodiments represented in the drawing. The features which can be derived from the description and the drawing can be applied to other embodiments of the invention either individually and in and of themselves or collectively in arbitrary combination. Shown are.

DESCRIPTION OF THE PREFERRED EMBODIMENTS

With multi-layer magnet windings a layer transition occurs at each position where the coil wire or, in general, the conducting elements from which the magnet coil is wound go from one layer into the next layer. If the conductor diameter is negligibly small compared to the coil diameter, then the defect in the homogeneity of the coil's magnetic field which is caused by the layer transition is correspondingly negligible. However, in many cases in which magnetic fields of very high homogeneity are necessary, the magnetic coils must be wound from relatively thick conducting elements.

Figures 1A, 1B, 1C, 1D:
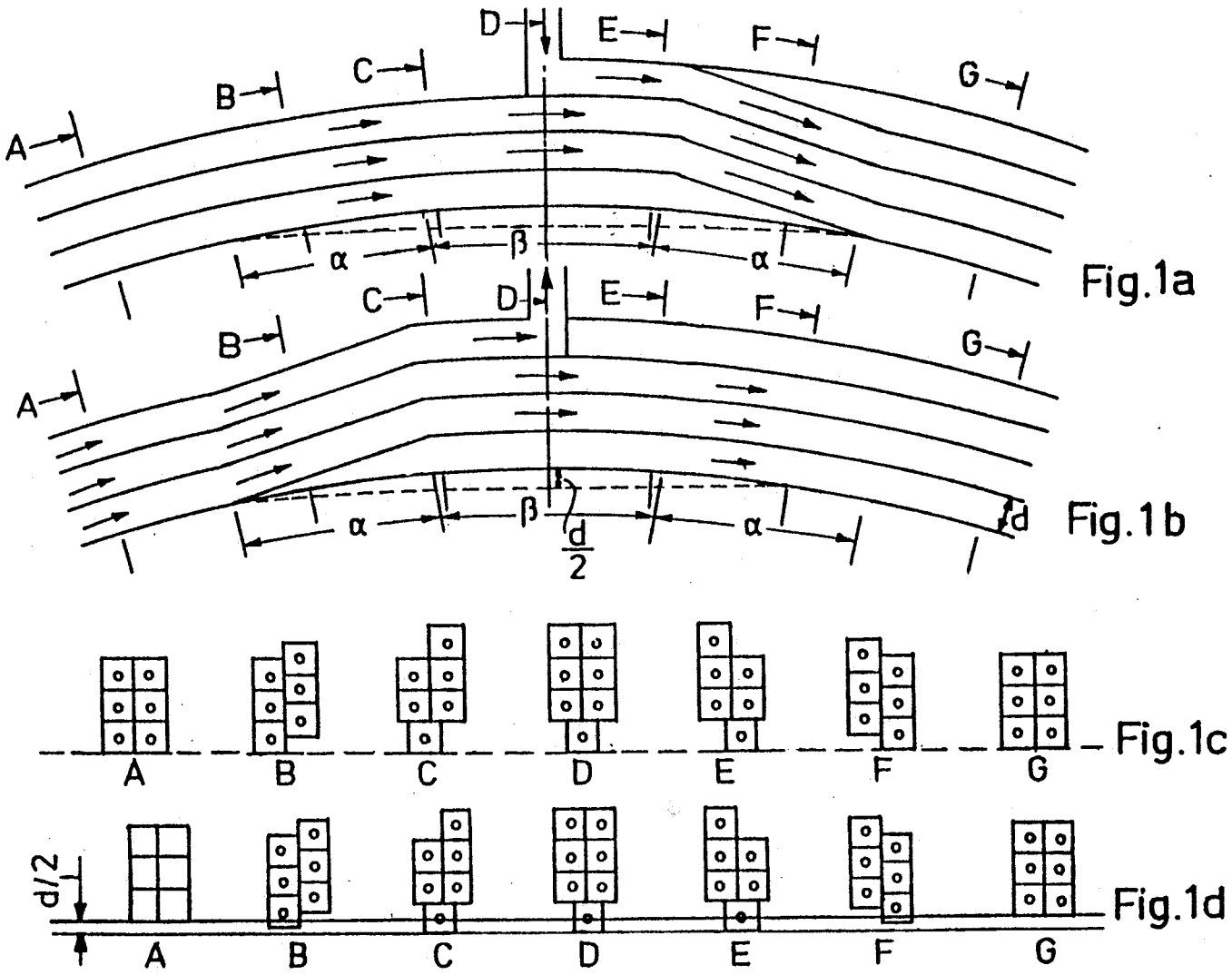
FIG. 1*a* a plan view of a portion of the lower layer of a "pancake" coil in the direction of the magnetic field axis, FIG. 1*b* a partial plan view of the upper layer of a "pancake" winding, FIG. 1*c* plan views of axial cuts A through G through the "pancake" configuration of FIGS. 1*a* and 1*b*.
FIG. 1*d* plan views of axial cuts A through G with a radially inwardly displaced coil edge.

Shown in FIG. 1 is an example of a double layer winding packet of the so-called "pancake" winding technique as is, by way of example, described in the above quoted publication of Montgomery. FIG. 1*a* shows a section of a plan view of the lower of the two layers in the field axis direction, whereas FIG. 1*b* represents a corresponding section of the top layer, also in an axial plan view. A conductor, introduced from the outside, is, radially seen, wound in the lower layer (FIG. 1*a*) about the coil axis from the outside towards the inside and ascends with its radially innermost winding in the region of the coil transition into the top layer (FIG. 1*b*) where it is wound from the inside towards the outside and, after the third winding, is finally lead away from the outside of the coil. The layer transition is effected in a transition region of about 25 degrees about the coil axis, whereby in a descending region which extends through an angle o equal to 7.5 degrees, the three windings of each respective layer are radially directed inwards relative to their original position by one winding height, that is to say, by an amount corresponding to one conducting diameter. This region of descent to the lower layer is represented in FIG. 1*a* to the right of the conductor inlet, whereas a corresponding ascending region of the upper layer is to the left of the conductor outlet in FIG. 1*b*. Symmetrically positioned between the two ascending and descending regions is the interlaced region which extends over an angle $\beta = 10$ degrees, where the radially innermost conducting element of the lower layer bends-off in an upward direction shortly before cut C and, shortly after the cut E reaches the axial plane of the upper layer where it is further guided in this plane. The angular region in which the layer transition leads to a field error therefore extends over a total of 25°, whereby the main contribution to the winding error stems from the interlaced region ($\beta = 10°$).

FIG. 1*c* shows various sectional views of the two windings which lie on top of each other. In cut A the upper and lower layers of three windings each lie, axially seen, on top of each other and, radially seen, closely adjacent to the inner coil edge. In cut B one notices that the upper layer windings, which are represented at the right in each of the sectional illustrations of 1*c*, exhibit an outward radial displacement from the inner edge of the coil, whereas the lower layer windings represented to the left lie closely adjacent to the inner edge of the coil. Section C shows that, shortly after the end of the left ascending region which extends over the angle $\alpha$, the three windings of the upper layer are displaced radially outward by exactly one conducting diameter, while the innermost winding of the lower layer lies closely adjacent to the inner edge of the coil, but in the axial direction, is raised from the lower layer towards the upper layer. In the middle of the interlaced region of cut D, the axial position of the radially innermost winding is precisely between the two layers, whereas in cut E the ascending region of angle $\beta$ is nearly transcended and the innermost winding has almost reached the axial plane of the upper layer. In section D, the radially outermost winding of the upper layer has already been guided out, while an additional outermost winding of the lower layer then comes in through the conductor inlet. In section F, the innermost winding has executed the layer transition and lies fully in the axial plane of the upper layer; the descending region of the lower layer is approximately half-way effected and the three windings of the lower layer have radially approached the inner coil edge by approximately one half of a conductor diameter. Finally, in section G, the two layers again lie symmetrically on top of each other and their innermost windings are closely adjacent, to the inner edge of the coil.

FIG. 1*d* shows various sectional pictures of the windings which lie on top of each other, whereby the conducting elements are displaced radially towards the inside in the region of the layer transition in accordance with the invention. In the interlaced region (section D), the radial displacement assumes a value of approximately one half of a winding thickness, whereas in the ascending region (section B) and the descending region (section F), a smaller radial displacement is evident.

Within the descending and ascending regions (angle $\alpha$) and the interlaced region (angle $\beta$) the contributions to the magnetic field of the innermost winding of both layers are each less than in the other angular regions since, in this region, on the average, as is clearly seen in FIG. 1*c*, less than two conducting elements contribute to the field in the region of the innermost winding. In the interlaced region, the actual core region of the layer transition, the field contribution of the two layers at the position of their innermost windings is solely supplied from one single conducting element. In this region, an additional conducting element is effective beyond the outermost winding on the outer side of the coil due to the radial displacement of the windings. However, in consequence of its larger radial distance, this contributes less to the magnetic field than a conducting element at the position of the innermost winding on the coil inner edge would contribute. Therefore, a net local weakening of the coil's magnetic field occurs in the region of the layer transition.

The invention then allows this magnetic field weakening to be mitigated against and, in an advantageous case, completely compensated for. Towards this end, in the angular region of the layer transition, the innermost winding is positioned closer to the magnetic field axis, that is to say, is wound radially inwardly displaced towards the center of the coil by a certain amount. The winding separation denotes the radial distance between neighboring windings. This winding separation corresponds exactly to a wire thickness for a one wire coil. If the coil consists of many wires wound in parallel, then the winding separation is a whole number multiple of the wire thickness. In the example of FIG. 1, the new radially inward displaced coil inner edge is shown as a dashed line and has, in section D, a separation d/2, a half of a conducting element diameter, from the original coil inner edge. In a rotationally symmetrically wound coil, the new coil inner edge could, in a simple case, follow a chord extending from the beginning of the interlaced region represented to the left of the upper layer to the end of the interlaced region represented to the right of the lower layer.

Figure 2:
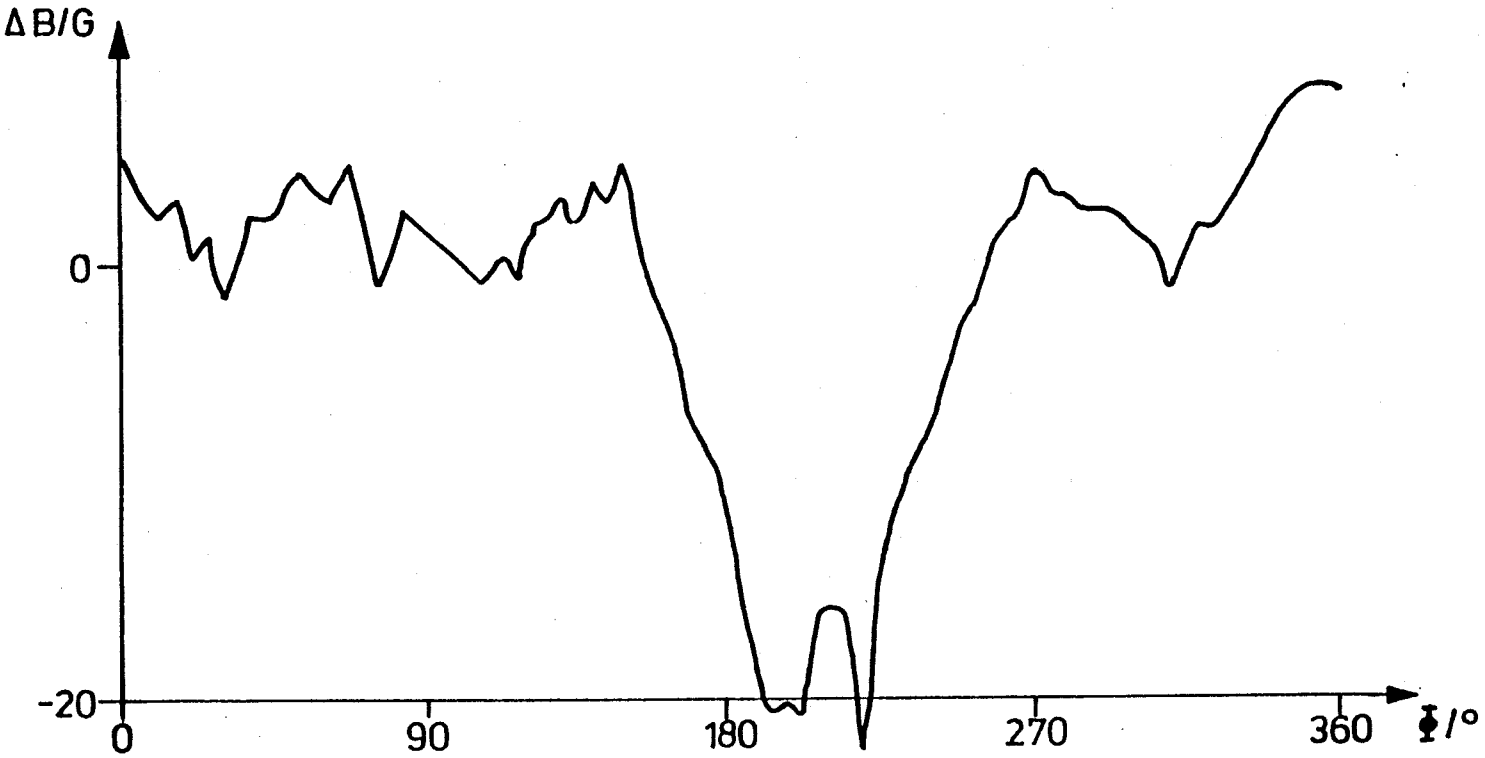
FIG. 2 an experimentally determined magnetic field curve over the angular region Φ about the field axis at a measurement radius of 400 mm.

The actual field error was measured experimentally in a single field-coil which consisted of six double layered "pancake" coils and was produced without the modification according to the invention. The coil exhibited an inner diameter of 900 mm, was wound from hollow copper wire of square cross section with an edge length of d=11.6 mm and produced a magnetic field of approximately 800 G ($=80\times10^{-3}$ Tesla). The result of the measurement of the field breach due to the layer transition is shown in FIG. 2 where δB, the field change over an angular span Φ measured in Gauss at a radial separation of 400 mm from the coil axis, is represented. A local field breach of the order of magnitude of approximately 20 G is very clearly seen between the angular positions Φ=170 and Φ=260 degrees.

Figure 3:
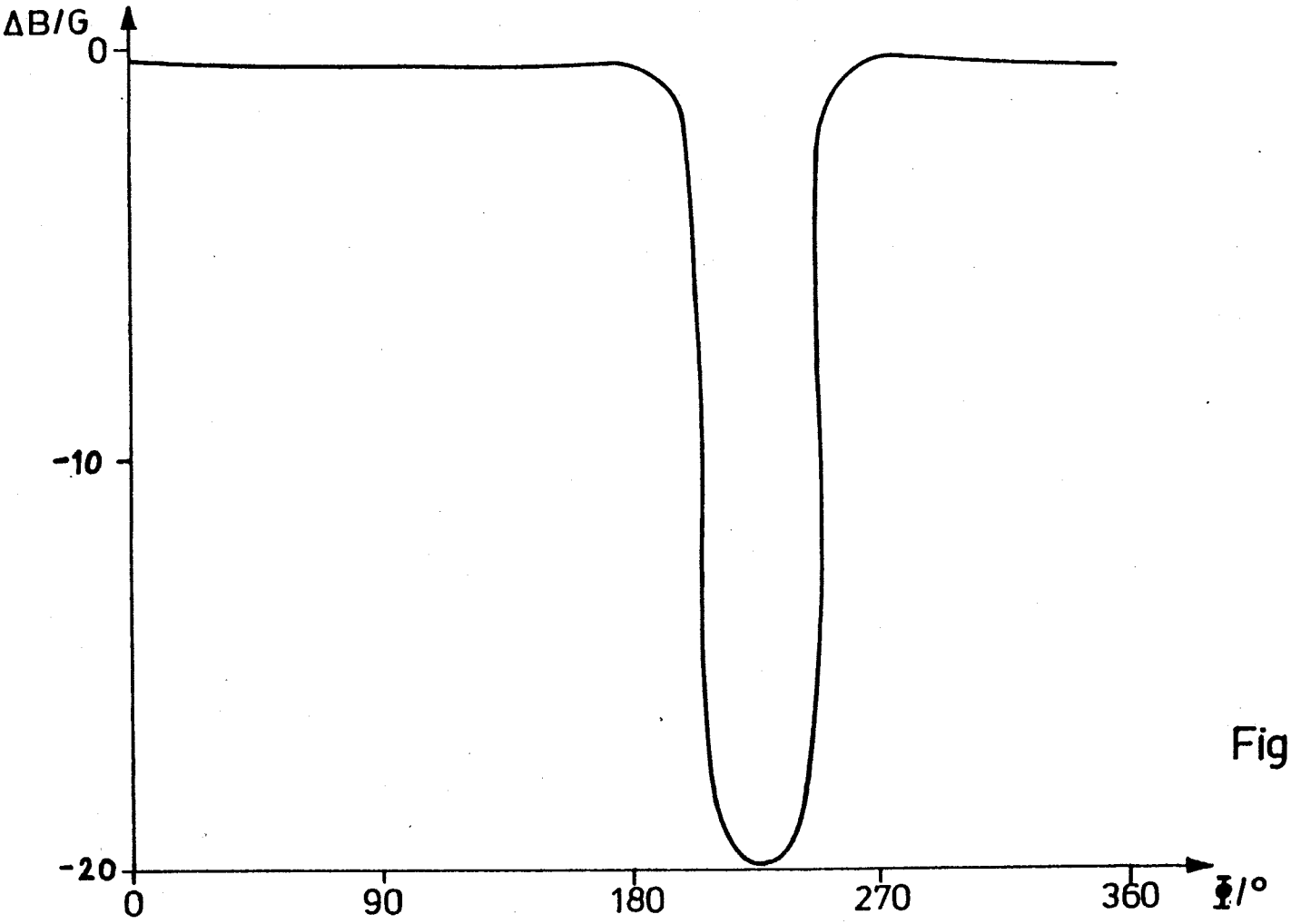
FIG. 3 the results of model calculations for the magnetic field distribution about the field axis, and FIG. 4 a comparison between the theoretical field distribution of a conventionally wound magnetic field coil with the theoretical field distribution in a modified magnetic winding according to the invention at a measurement radius of 180 mm.

FIG. 3 reproduces the result of a model calculation with which, with the aid of the Biot-Savart-law, the field distribution of the actual winding configuration was simulated. The calculation shows a relatively good quantitative agreement with the experimentally determined field errors.

Figure 4:
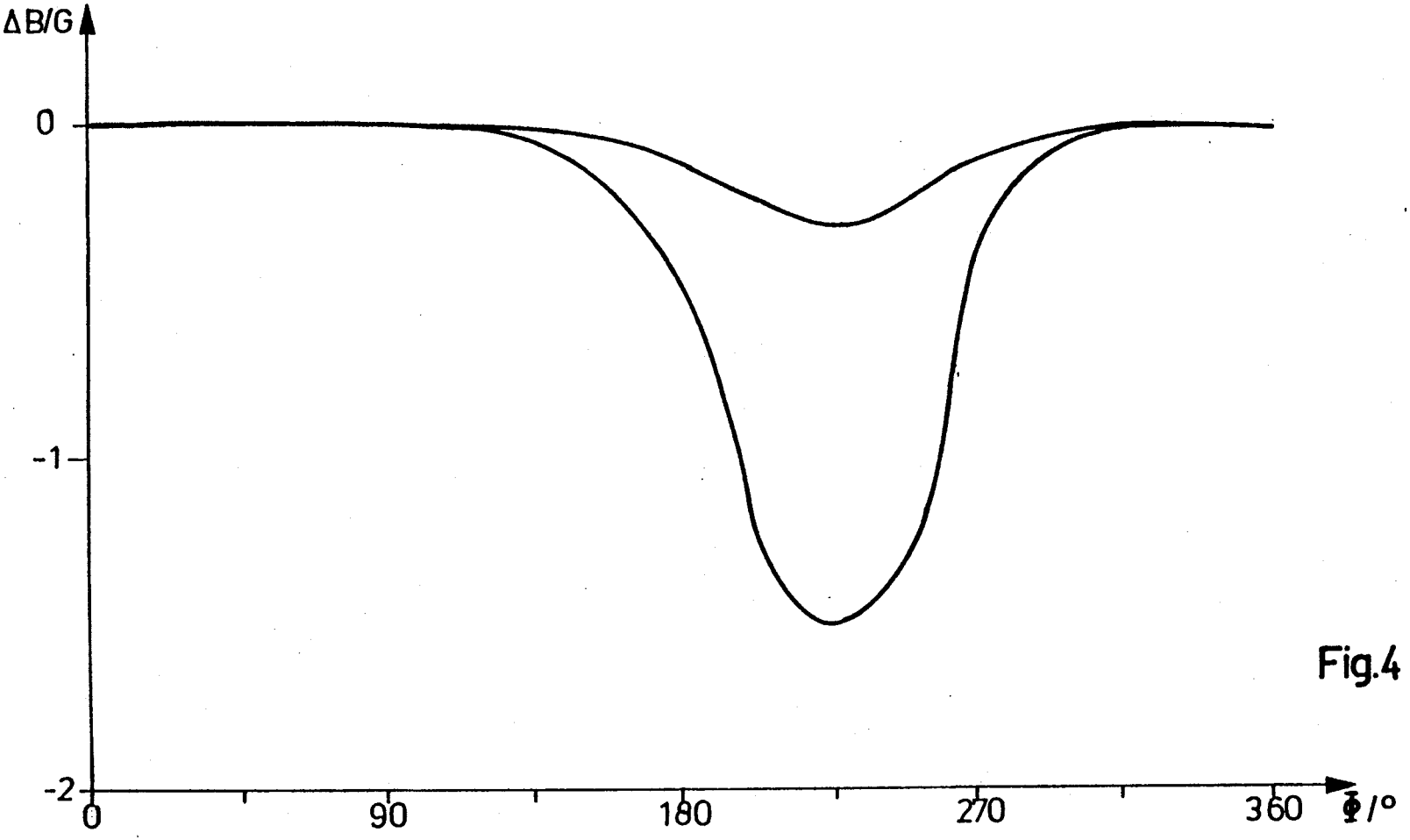

Finally, FIG. 4 compares a theoretically calculated field distribution for a symmetrically wound coil (lower curve) at a radial distance of 180 mm from the field center and a magnetic field strength of approximately 3 kG to that of a coil modified in accordance with the invention (upper curve) with an inner coil edge displaced in the direction of the field center at the region of the layer transition. The layer transition which, in FIG. 4, is located in the region of the angular position Φ=225 degrees, leads to a field error in the conventional coil of approximately 1.5 G and in the coil according to the invention only to an error of approximately 0.3 G, that is to say, only one fifth of that associated with the symmetrically wound coil.

In the coil described above, whose inner diameter was 900 mm, the production tolerance for the radial positioning of the conducting elements assumes a value of approximately 0.5 mm. The displacement of the radially innermost winding in the region of the layer transition according to the invention assumes a value of one half of a layer diameter, that is to say $d/2\approx6$ mm so that the geometrical modification exceeds the production tolerance by more than a factor of 10 and, therefore, is technically easy to realize.

For a a total field, produced by four field coils, of approximately 3 kG, a homogeneity of $10^{-4}$, which is by way of example required in NMR tomography, means that maximum field errors of the order of 0.3 G are allowable. These values are comparable to those achieved in the localized field breach corresponding to the layer transition in the coil modified in accordance with the invention, whereas the local field inhomogeneity in a conventionally wound coil, as shown above, is of the order of 1.5 G, that is to say, is clearly too large.

The field error caused by the layer transition increases with the diameter of the conducting element relative to the winding radius of the magnet winding. In the embodiments described, the diameter of the conducting element assumes a value of more than 1/50 of the inner diameter of the coil. Furthermore, the size of the error caused by the layer, transition increases with the number of windings per layer, since, with higher winding numbers, the radial separation of the outermost winding from the field center increases. Therefore, the compensating effect of the additional conducting element on the outside of the coil in the vicinity of the layer transition is correspondingly weaker. In the embodiment described above, 17 windings per layer were successively radially wound.

In an embodiment of the invention not shown, the magnet winding forms an n-fold Helmholtz configuration with which the magnetic field terms can be zeroed up to order 2n . It is, in combination with the modification in accordance with the invention, thereby possible to produce an extremely homogeneous magnetic field.

The invention can also be applied to magnetic coils which do not exhibit rotational symmetry, rather exhibit solely an axially symmetric construction with respect to the magnetic field axis as in, by way of example, coils with square, 5 corner or 6 corner cross sections and the like. In this case, in the region of the layer transition, the radially innermost winding of the respective layer has, in accordance with the invention, a smaller radial separation from the coil axes than the corresponding cross sectional contour at this position.

The term "air coil configuration" is also to be understood to represent a magnet winding which is surrounded by a ferromagnetic cylindrical, jacket serving as a flux return. The expression "air coil" is, therefore, utilized in contrast to the expression "pole piece magnet". In the latter, the modification according to the invention would not be reasonable since the magnetic field and the field homogeneity of such a pole piece magnet is determined solely by the shape of the pole piece. The geometry of the coil configuration about the core does not matter in this case.

Figure 1E:
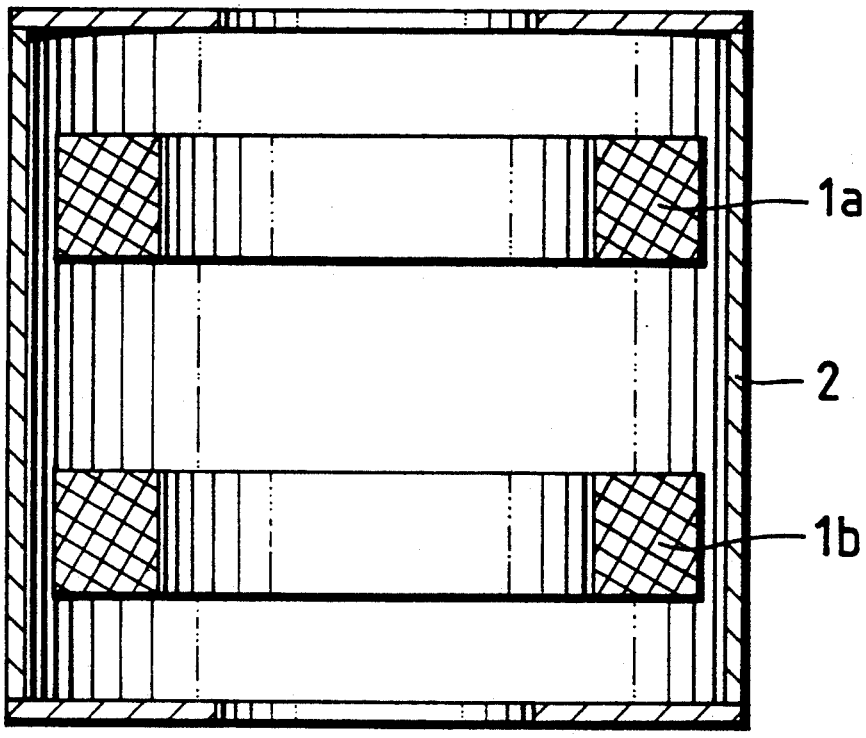
FIG. 1*e* shows an alternative embodiment of the present invention in which the magnet winding is formed from two circular cylindrical coaxial field coils.

In a particularly preferred embodiment of the invention the magnet winding modified in accordance with the invention comprises at least two circularly cylindrical coaxial field coils 1*a*, 1*b*, shows in FIG. 1*e*, whereby the magnet winding is surrounded by a ferromagnetic cylinder jacket 2 whose influence on the homogeneity of the magnetic field produced by the coil configuration in an inner region defined by them, said inner region being accessible and suitable for accepting the body to be examined, is compensated for through the dimensioning of the field and correcting coils. Such a magnet winding is particularly suitable as part of a superconducting configuration for NMR tomography, where a patient is completely or partially brought into the magnetic field for purposes of examination. The iron shielding must then exhibit a correspondingly large opening so that, in this configuration, one is not dealing with a pole piece rather with an "air coil configuration" in the sense of the above definition.

The magnet configuration according to the invention can be produced in differing ways: on the one hand, at least the radially innermost winding of the respective magnet winding can, in the angular region of the layer transition, be wound with a smaller radial separation from the coil axis than that of the other angular region. This can be effected in the most reasonable fashion by utilizing a winding template for the winding which exhibits a respective radial recess in its radial periphery in the region of the layer transition which, in its axial direction, extends over the region of those layers between which the layer transition occurs.

Finally, in another method, it is possible to modify an already wound conventional coil in accordance with the invention by attaching an additional conductor piece in an electrically conducting fashion to the radially innermost respective winding in the angular region of the layer transition. This can, by way of example, transpire through soldering or welding of the additional conducting piece.

The invention can also be correspondingly applied using a winding technique wherein a "pancake" coil is comprised of two conductors wound parallel to another in a radial direction which are electrically connected in series, and, with respect to their cooling circuit, connected in parallel. One such parallel winding is described in the above quoted publication of D. B. Montgomery on page 56, FIG. 3.10*b*. If two conductors are wound parallel in a radial direction, the winding separation corresponds to double the winding thickness. Correspondingly, in the region of the layer transition, the, windings are approximately displaced towards the inside by one wire thickness.

What is claimed is:

1. Magnet winding comprising windings made from conducting elements forming a coil having a longitudinal axis and surrounding a magnetic field axis which is coincidental with the coil longitudinal axis, said windings being wound in at least two layers separated along the longitudinal axis, said layers being interconnected by at least one layer transition, said windings having an angular region about the magnetic field axis which includes the layer transition, and a radial separation from the magnetic field axis of at least a radially innermost winding of one respective layer is less than that of a radial separation of the innermost winding in another angular region, the radial separation of at least a radially innermost winding of the respective layer from the magnetic field axis, at a middle of the angular region being less than that outside of the angular region by about half a radial extent of the conducting element.

2. Magnet winding according to claim 1 wherein the number of windings per layer is larger than 2.

3. Magnet winding according to claim 2 wherein the number of windings per layer is larger than 10.

4. Magnet configuration according to claim 1 wherein the diameter of the conducting elements is at least 1/1000 of the winding radius of the magnet winding.

5. Magnet winding according to claim 4, wherein the diameter of the conducting element is at least 1/100 of the winding radius of the magnet winding.

6. Magnet winding according to claim 4 wherein the conducting elements are formed from a copper wire of rectangular cross section with an edge length of 10 to 12 mm and a bore penetrating perpendicular to the cross section, and an inner diameter of the magnet winding is between 800 and 1000 mm.

7. Magnet winding according to claim 1 wherein the magnet winding has a construction which deviates from axial symmetry with respect to the magnetic field axis only in an angular region about the magnetic field axis which includes the layer transition.

8. Magnet winding according to claim 7 wherein the magnet winding has an essentially rotationally symmetric construction.

9. Magnet winding according to claim 8, wherein the magnet winding forms an n-fold Helmholtz configuration.

10. Magnet winding according to claim 1, wherein the magnet winding is constructed of two layer opposite spiral windings each in accordance with the "pancake" technique.

11. Magnet winding according to claim 1, wherein the angular region about the magnetic field axis including the layer transition is between 10 degrees and 30 degrees.

12. Magnet winding according to claim 11, wherein the angular region about the magnetic field axis including the layer transition is approximately 25 degrees.

13. Magnet winding according to claim 1, wherein the magnet windings are wound on a winding template in order that, in the angular region about the magnetic field axis a radial separation of at least a radially innermost winding of the respective layer from the magnetic field axis, is less than that outside of the angular region.

14. Magnet winding comprising windings made from conducting elements forming a coil having a longitudinal axis and surrounding a magnetic field axis which is coincidental with the coil longitudinal axis, said windings being wound in at least two layers separated along the longitudinal axis, said layers being interconnected by at least one layer transition, said windings having an angular region about the magnetic field axis which includes the layer transition, and a radial separation from the magnetic field axis of at least a radially innermost winding of one respective layer is less than that of a radial separation of the innermost winding in another angular region, the radial separation of at least the radially innermost winding of the respective layer from the magnetic field axis, at the middle of the angular region, is less than that outside the angular region by a multiple of one-half of a radial extent of the conducting element.

15. Magnet winding according to claim 1, wherein the magnet winding is part of a coil configuration for NMR tomography.

16. Magnet winding according to claim 15, wherein the magnet winding is formed from at least two circular cylindrical coaxial field coils and is surrounded by a ferromagnetic cylindrical jacket, the influence on homogeneity of the magnetic field produced by the coil configuration in an inner region defined by the coil configuration being compensated for through the dimensioning of the field coils, said inner region being accessible and suitable for accepting a body to be examined.

17. Magnet winding according to claim 14 wherein the number of windings per layer is larger than 2.

18. Magnet winding according to claim 17 wherein the number of windings per layer is larger than 10.

19. Magnet configuration according to claim 14 wherein the diameter of the conducting elements is at least 1/1000 of the winding radius of the magnet winding.

20. Magnet winding according to claim 19, wherein the diameter of the conducting element is at least 1/100 of the winding radius of the magnet winding.

21. Magnet winding according to claim 19 wherein the conducting elements are formed from a copper wire of rectangular cross section with an edge length of 10 to 12 mm and a bore penetrating perpendicular to the cross section, and an inner diameter of the magnet winding is between 800 and 1000 mm.

22. Magnet winding according to claim 14 wherein the magnet winding has a construction which deviates from axial symmetry with respect to the magnetic field axis only in an angular region about the magnetic field axis which includes the layer transition.

23. Magnet winding according to claim 22 wherein the magnet winding has an essentially rotationally symmetric construction.

24. Magnet winding according to claim 23, wherein the magnet winding forms an n-fold Helmholtz configuration.

25. Magnet winding according to claim 14, wherein the magnet winding is constructed of two layer opposite spiral windings, each in accordance with the "pancake" technique.

26. Magnet winding according to claim 14, wherein the angular region about the magnetic field axis including the layer transition is between 10 degrees and 30 degrees.

27. Magnet winding according to claim 26, wherein the angular region about the magnetic field axis including the layer transition is approximately 25 degrees.

28. Magnet winding according to claim 14, wherein the magnet winding is part of a coil configuration for NMR tomography.

29. Magnet winding according to claim 28, wherein the magnet winding is formed from at least two circular cylindrical coaxial field coils and is surrounded by a ferromagnetic cylindrical jacket, the influence on homogeneity of the magnetic field produced by the coil configuration in an inner region defined by the coil configuration being compensated for through the dimensioning of the field coils, said inner region being accessible and suitable for accepting a body to be examined.

30. Magnet winding according to claim 14, wherein the magnet windings are wound on a winding template in order that, in the angular region about the magnetic field axis, a radial separation of at least a radially innermost winding of the respective layer from the magnetic field axis, is less than that outside of the angular region.

* * * * *